US005543828A

United States Patent [19]

Minowa

[11] Patent Number: 5,543,828

[45] Date of Patent: Aug. 6, 1996

[54] RECORDING APPARATUS HAVING A PRINT HEAD DRIVE APPARATUS WITH AN IC DRIVE CIRCUIT EMPLOYING SHIFT REGISTERS FOR HANDLING DRIVE DATA IN SEQUENTIAL FASHION AND A METHOD FOR DRIVING THE PRINT HEAD

[75] Inventor: Masahiro Minowa, Suwa, Japan

[73] Assignee: Seiko Epson Corporation, Tokyo, Japan

[21] Appl. No.: 278,587

[22] Filed: Jul. 21, 1994

[30] Foreign Application Priority Data

Jul. 21, 1993 [JP] Japan ..... 5-180389
Jul. 12, 1994 [JP] Japan ..... 6-160198

[51] Int. Cl.[6] ..... B41J 2/36; B41J 2/375

[52] U.S. Cl. ..... 347/195; 347/211

[58] Field of Search ..... 347/195, 211; 400/120.15

[56] References Cited

U.S. PATENT DOCUMENTS 4,364,063 12/1982 Anno et al. ..... 347/195
4,912,485 3/1990 Minowa ..... 347/195

FOREIGN PATENT DOCUMENTS 57-208281 12/1982 Japan .

*Primary Examiner*—Huan H. Tran

[57] ABSTRACT

A recording apparatus having a print head control apparatus containing an IC drive control circuit utilizes at least two shift registers having N single bit registers with respective data input terminals sequentially switched to receive print data wherein, at any one print cycle, one shift register is storage for current print data and the other shift register is storage for past print data so that, on the succeeding print cycle, the latter shift register receives new print data and the former shift register becomes the holder of past print data. When one of the shift registers provides output for the current print data to the thermal print head drivers, the other shift register is employed for referencing the past print data, i.e., comparing current and past print data. Thus, the function of shift registers are sequentially switched to control the drive data output to the thermal elements of the print head based on past print data history. Logical circuitry is employed comprising gate circuits for referencing or comparing the current print data with past data history relative to each individual thermal element of a plurality of N thermal elements. At least first and second strobe signals are provided having respectively first and second pulse widths which may be individually or collectively applied to each respective individual thermal element for application of current print data based upon its past print data history over one or more preceding print cycles.

19 Claims, 6 Drawing Sheets

RECORDING APPARATUS HAVING A PRINT HEAD DRIVE APPARATUS WITH AN IC DRIVE CIRCUIT EMPLOYING SHIFT REGISTERS FOR HANDLING DRIVE DATA IN SEQUENTIAL FASHION AND A METHOD FOR DRIVING THE PRINT HEAD

BACKGROUND OF THE INVENTION

1. Field of the Invention

This invention relates to a recording apparatus utilizing print head control apparatus having a plurality of print elements and an IC control circuit for driving the thermal elements and to a method of driving the thermal elements and, more particularly, to a thermal recording apparatus with selection means for driving a plurality thermal print elements in a thermal print head of the thermal recording apparatus.

2. Description of the Related Art

U.S. Pat. No. 4,364,063 discloses a thermal recording apparatus in which a line of resistive type thermal elements are selectively driven according to current and previous (historical) recording signals. The drive of the thermal elements on not only the current but also the previous recording signals is done in order to avoid excessive heating in case the recording signals require one and the same thermal element to be driven in successive print cycles or print lines. Thus, in a current print cycle, less electric energy will be applied to a thermal element that was energized or activated in the preceding recording cycle, than to a thermal element that was not activated in the preceding recording cycle. This is commonly referred to as "historical drive control". To accomplish such a historical drive control, U.S. Pat. No. 4,364,063 employs two or three shift registers and a latch circuit each having a plurality of single bit registers or stages corresponding to the number of thermal elements to be driven. First, the drive data for one print line (one data for each thermal element) are loaded into a first one of the shift registers and then transferred to the latch circuit. In accordance with the data in the latch circuit, a first drive pulse is applied to selected ones of the thermal elements. Then, the drive data are sequentially read out from the first shift register and written into the second shift register while at the same time the previous drive data are read out from the second shift register. The data of corresponding stages of the first and second shift registers are compared with each other and either are the data in the respective register or stage of the first shift register or that of a third shift register modified depending on the comparison result. The modified data from the first or the third shift register are then latched in the latch circuit. In accordance with the data in the latch circuit, a second drive pulse is applied to selected ones of the thermal elements. This process is periodically repeated, each cycle corresponding to one print line. As a result, in a certain cycle, each thermal element to be activated in this cycle, but not activated in the preceding cycle, will be activated during a time corresponding to the sum of the first and second drive pulses, while thermal elements to be activated in this cycle, that have also been activated in the preceding cycle, will be activated during the first drive pulse only.

As will be appreciated from the foregoing description, in this prior art because there is only one latch circuit, it is necessary to completely replace the current drive data and the previous (historical) data each print cycle. This limits the operating speed and increases the complexity of the control system.

For further explanation and understanding of historical drive control, reference is made to U.S. Pat. No. 4,912,485, assigned to the assignee herein and incorporated herein by reference thereto.

Another prior art disclosed in JP-A-208281/1982 seeks to eliminate this problem by providing two latch circuits and connecting the shift register to both latch circuits. In this case, one latch circuit is employed to store past drive data while the other stores current drive data. The drawback of this method is the increased cost incurred by providing an additional latch circuit.

Moreover, the printing speed in thermal recording apparatus is of paramount concern. Take, for example, a journal or receipt thermal printer employed in a point-of-sale (POS) printing system, such as, an electronic cash register, that employs a thermal print head having 512 dots corresponding to 512 thermal elements and capable of handling a 4 cm. to a 6 cm. paper width. Correspondingly, the thermal print head must have a 512 bit stage, shift register. In the case of providing input drive data to a shift register utilizing a transfer rate of 4 Mbits/sec (4 MHz cycle), it will take 0.25×512=128 μsec., i.e., for one dot line of a printing period, it will take 128 μsec. for the transfer of the data for one print line. When the thermal recording apparatus also executes a historical control system in accordance with U.S. Pat. No. 4,364,063, it will take 512 μsec. for exchanging the data for historical control and for providing input of new drive data. Furthermore, taking into consideration the necessary time period for activation of the thermal elements, the time interval for the successive print cycles will become greater thereby reducing printing speed. Under these circumstances, the data transfer time becomes sufficiently large as not to be ignored, such as, in the case where an extended print line length in a thermal print head is involved, such as, in the case of a facsimile machine employing A4 size paper width.

OBJECTS OF THE INVENTION

Accordingly, it is an object of this invention to provide a recording apparatus having a print head employing a plurality of thermal elements that renders it possible to reference past print data history employing simple control circuitry to provide good print quality and uniformity without increasing the cost of the control circuitry.

SUMMARY OF THE INVENTION

In accordance with this invention, a recording apparatus includes a print head drive apparatus comprising a plurality of N thermal elements and at least two storage means, such as, a plurality of N-bit stage, shift registers wherein in drive data is sequentially shifted into the respective registers, the newer drive data in one of the shift registers is compared or referenced with the older drive data in the other shift register. Based upon the results of the comparison, the activation time, i.e., the period of time for turning on the respective N thermal elements during a current print cycle, is applied relative to the current print data provided as output from one of the shift registers. When one of the shift registers is designated for storing current print data, the other shift register is designated for storing past print data. In the next drive or print cycle, the shift register storing the current print data is employed for comparing or referencing with the shift register storing the past print data, after which, new drive data is provided to the shift register that had been previously storing the past print data. Thus, the shift register now storing the new drive data is redesignated as the storing of current print data and the shift register storing the current print data becomes redesignated as the store of past print data. By thus sequentially switching between the shift registers and comparing sequentially supplied print data in the respective shift registers, it is possible to control the thermal elements while setting the drive data of the thermal elements based on the past print data history by employing a simple comparison technique.

Thus, in its simplest form, the apparatus and method of print head operation involves at least two shift registers with alternate switching between two shift registers, or sequential switching among several shift registers, upon application of the current print data to the thermal elements of the print head. At the point of activation by applied current to the thermal elements, the shift register storing the current print data in the current print cycle is referenced or compared with the past print data history during the next print cycle, and in the next print cycle, the new drive data is provided as input to the shift register employed in the previous print cycle to reference the past print data history. As a result, the thermal elements are controlled by sequentially switching relative to current and past print data in the shift registers.

Thus, according to this invention, a recording apparatus comprises a print head control apparatus having a plurality of storage means, such as, a plurality of serial-parallel out shift registers, are employed for storing drive data of a plurality of bits representing print data, which bits correspond to the number of thermal elements to be driven in the recording apparatus print head. The actual number of storage means depends on the kind of historical control adopted, i.e. whether, in addition to the drive data to be provided as output for the current print cycle, those of one or more preceding print cycles are to be considered in the historical determination. If the number of preceding print cycles to be considered is M-1, the number of storage means that is to be employed is M. At the begin of each print cycle one of the storage means holds the drive data for the current print cycle while each of the remaining M-1 storage means holds the print data of a respective one of the M-1 preceding print cycles. As is the case in the case of the prior historical control systems, such as found in U.S. Pat. No. 4,912,485, the total period possible for selection as the activation period for each of the thermal elements during each print cycle comprises M separate periods of activation which may be one, two or more time intervals of pulse drive activation. Such time intervals may be of equal or different time lengths or even time varied periods dependent upon other operating factors. A thermal element which, according to the print data for the current print cycle, is to be activated will be activated for at least one of these time intervals. Whether it will also be energized or activated during any one or more of the other time intervals is determined by referencing with print data of M-1 preceding print cycles. Each of these other time intervals is assigned to one of the preceding print cycles. If the first time interval is assigned to the oldest one of the preceding print cycles, the drive data of that cycle must be available during this first time interval but is no longer required after the elapse of the time interval. Therefore, the time period after the end of the first time interval and until the end of the current print cycle can be advantageously employed to write new print data into the storage means holding the oldest print data prior to the next print cycle. If the storage means are assumed to be numbered 1 through M, the number of the storage means receiving the new print data will change in a cyclical order every print cycle and so will, of course, the time rank of the print data in the other or remaining storage means.

The print head drive method of this invention as applied in a print head control apparatus in a thermal recording apparatus of this invention provides for output of data from one shift register as the print data and employs the other shift register during the same print cycle for past print history for purposes of data comparison. Synchronized with print timing, the current print data is sequentially provided as output, based on the result of comparing the oldest past print data, thence the oldest print data is then compared with the current print data, and the next current sequence of print data is provided as input to this latter shift register.

By means of the circuit configuration and procedure of operation of this invention, both the current print data and the past print data are simultaneously stored and are available as required. By adding a means for sequentially switching the data flow, it is not necessary for the print head control processor to determine which data in the shift registers is the current print data and which is the past print data. In addition, by employing gate means to execute the data comparison operations, the processor controlling the print head can simply input the data to the serial input terminal in conjunction with print head activating timing so that a predetermined activation time can be determined and applied.

Other objects and attainments together with a fuller understanding of the invention will become apparent and appreciated by referring to the following description and claims taken in conjunction with the accompanying drawings.

DESCRIPTION OF THE PREFERRED EMBODIMENTS

Figure 1:
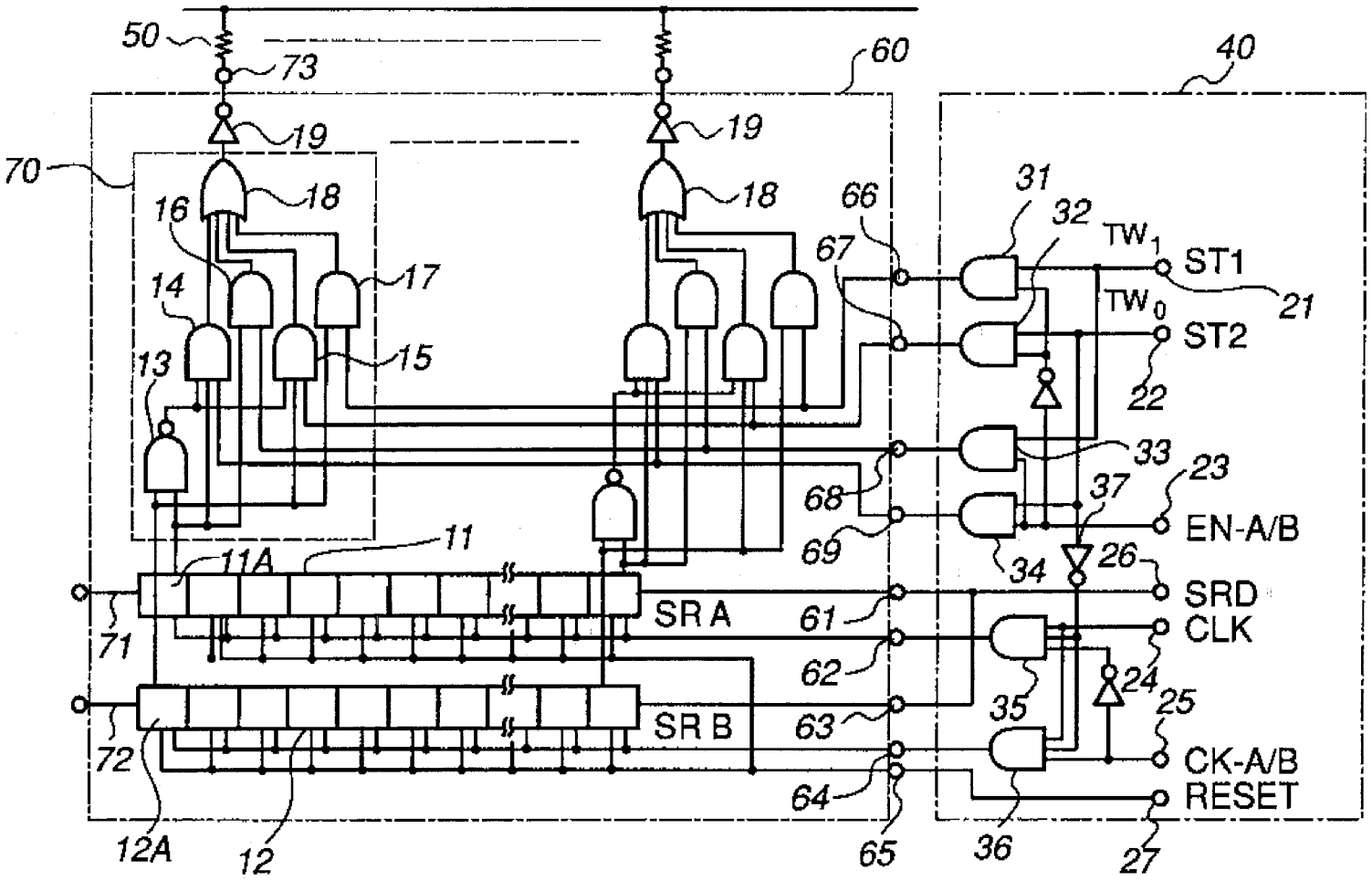
FIG. 1 is a circuit diagram of a first embodiment of a print head drive apparatus in accordance with this invention.

The preferred embodiments of this invention are described below with reference to the accompanying figures wherein FIG. 1 shows a first embodiment of a print head drive control apparatus for a recording apparatus comprising this invention.

As shown in FIG. 1, the print head control apparatus for a thermal recording apparatus comprises drive control unit 60 for controlling and driving N thermal elements 50 of a print head (not shown). Units 60 has two shift registers 11, 12, also referred to as parallel-out serial shift register A (SR A) and parallel-out serial shift register B (SR B). Each shift register A and B has N single bit registers or stages 11A, 12A used as storage circuits for the print data. Individual registers 11A, 12A store the drive data modified and used for driving print head thermal elements 50. The print data is stored in such a manner that ON state data for energizing or activating a thermal element is equal to a logical level of "1" or HIGH.

Data input/output timing control unit 40 is connected to drive control unit 60 and controls the data input and output, the time period of thermal element activation and the activation timing of thermal elements 50. Unit 40 is connected to input terminals 61–69 of unit 60.

Print data SRD applied to a common data input terminal 26 and clock pulses CLK applied to a common clock input terminal 24 are supplied, via data input terminals 61, 63 and clock input terminals 62, 64, respectively, of drive control unit 60 to the two shift registers A and B to enable serial data input to a selected one of the shift registers. The shift registers are normally reset by applying a RESET signal to a reset terminal 27 connected to input terminal 65 of unit 60 immediately before a print job starts or at a power on state.

A signal CK-A/B, applied to a data input selection terminal 25, selects to which of the shift registers the new print data for the next print cycle should be transferred, and the input destination of clock input terminal 24 is selected by AND circuits 35, 36 such that the clock pulses are supplied to clock input terminal 64 and data is provided as input to shift register B when data input selection terminal 25 is HIGH, while the clock pulses are supplied to clock input terminal 62 and data is provided as input to shift register A when data input selection terminal 25 is LOW. The print data is provided as input sequentially, or alternately in this embodiment, to the two shift registers during consecutive print cycles between timing pules, $t_n$. The shift register employed to input the first data is selected using input terminal 25, and the initial print data is provided as input to the selected shift register. Because of the alternating print data input selection, during each print cycle one of the shift registers holds the current print data while the other holds the previous print data so that there is no necessity for transferring print data from one shift register to the other shift register.

A signal EN-A/B, applied to an enabling selection terminal 23, controls which of the two shift registers A and B is to be employed for holding the current print data. When enabling selection terminal 23 is HIGH, gate circuits 31, 33 set shift register A as the current print data storage means and when it is LOW, gate circuits 31, 33 set shift register B as the current print data storage means. A first activation period control circuit is formed from gate circuits 31, 33 in conjunction with a first strobe input terminal 21. The output terminals of gate circuits 31, 33 are connected to input terminals 66 and 68, respectively, of control unit 60. A second activation period control circuit is formed from gate circuits 32, 34 in conjunction with a second strobe input terminal 22. The output terminals of gate circuits 32, 34 are connected to input terminals 67 and 69, respectively, of control unit 60.

Control unit 60 includes N gate circuit groups 70, one for each of the N heating elements. Each gate circuit group 70 is connected to a pair of $n^{th}$ single bit registers of the shift registers A and B related to the same $n^{th}$ thermal element, and each group 70 comprises NAND circuit 13, AND circuits 14–17 and OR circuit 18.

AND circuit 16 is a first gate circuit for providing output of print data when shift register A is employed for the current print data storage. AND circuit 17 is a second gate circuit for providing output of print data when shift register B is employed for the current print data storage. Both of these circuits 16 and 17 are so constituted as to enable output of the respective print data to the respective thermal element during the pulse width, TW1, of activation signal ST1, which is a first strobe signal input from input terminal 21. Signal ST1 defines a second period of the activation time period. When the print data for a respective thermal head is "1", the thermal element is activated for this second time period.

NAND circuit 13 is a third gate circuit for providing the NAND result of a bit comparison of the outputs of a pair of $n^{th}$ single bit registers in shift registers A and B driving the same $n^{th}$ thermal element. AND circuit 14 is a fourth gate circuit to which the outputs of NAND circuit 13 and shift register B are provided, which is employed for historical or past print data when shift register A is used for current print data. When the compared bits are not both "1", gate circuit 14 provides for an increase in activation time by a first period comprising the pulse width, TWO, of activation signal ST2, which is a second strobe signal input from input terminal 22.

When the bits of the $n^{th}$ single bit registers in shift registers A and B driving the same $n^{th}$ thermal element are both "1", indicating a continuous on-state for the $n^{th}$ heating element, NAND circuit 13 outputs LOW and the activation time is not increased to include activation signal ST2.

AND circuit 15 is a fifth gate circuit whose function is the same as that of the AND circuit 14 when shift register B is used for current print data storage.

Gate circuit 18, comprising an OR gate, combines the outputs of AND gates 14, 15, 16 and 17 and provides an output to thermal element driver 19, such as a transistor, e.g., a MOS type transistor. Gate circuit groups 70, comprising gate circuits 13–18, also total N in number providing for optimized current flow periods corresponding to N outputs of shift registers A and B for N thermal elements so that the developed thermal energy is individualized for each thermal element at a preferred thermal activation time period. Thus, there are N bit serial data output terminals 73, and, of course, the number of serial data output terminals increases corresponding to the number of thermal elements.

Figure 2:
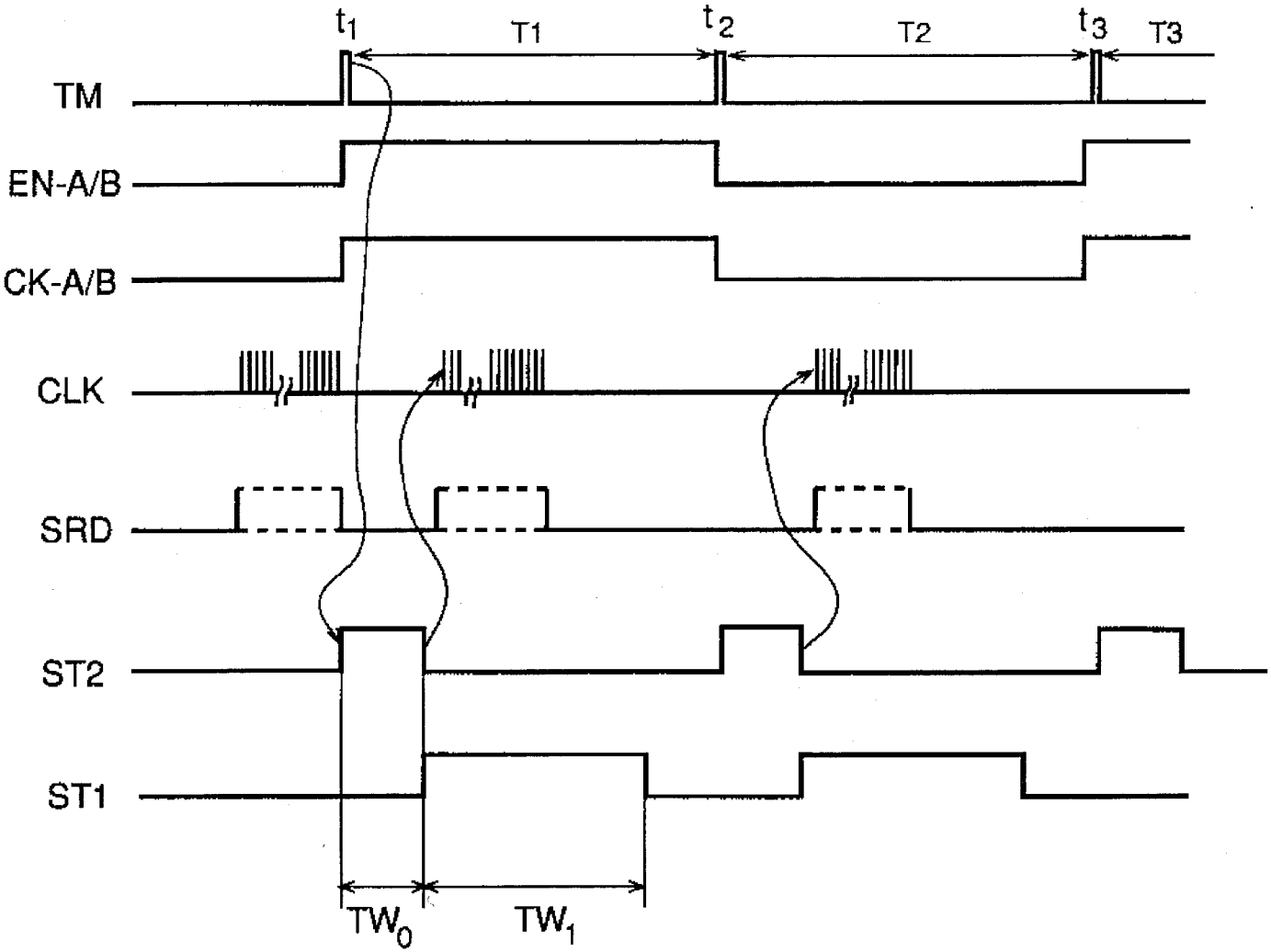
FIG. 2 is a timing diagram for explaining the drive method of the invention for the circuit as shown in FIG. 1.

The operation and method of driving the thermal head for the recording apparatus of this invention will now be described with reference to FIG. 2. Shown in FIG. 2 are a basic activation timing signal TM, the enabling selection signal EN-A/B, the data input selection signal CK-A/B, the clock signal CLK, the serial data input signal SRD, the second strobe signal ST2, and the first strobe signal ST1. Timing signal TM controls the print cycles of the thermal head, i.e., applied current corresponding to the print data is supplied to the thermal head during print cycles T1, T2 and T3 (FIG. 2). EN-A/B selects the shift register employed for receiving current print data. CK-A/B enables input of current print data to the selected shift register via application of the clock signal CLK to the selected shift register. During the activation time of the second strobe signal ST2, comparison of current and past print occurs and the output of the comparison takes place. During the activation time of the first strobe signal ST1, the output of the current print data from one shift register is enabled and the input of new print data is enabled in the other shift register.

An example of the operation of the circuit in FIG. 1 is as follows. Immediately after the power is turned on to the recording apparatus, i.e., before timing pulse $t_1$, shift registers A and B are reset, via RESET at 65. It is, therefore, possible to select either shift register at the first timing pulse, $t_1$, to receive the initial, first line of current print data. In the example here, CK-A/B is initially LOW and, therefore, print data is provided as input to shift register A in the print cycle before pulse $t_1$. At pulse $t_1$, after data input to register A is completed, the second strobe signal ST2 becomes HIGH and the current enable signal EN-A/B is received. Because the EN-A/B signal is also HIGH at this time, the drive data for thermal elements 50 is controlled via shift register A providing for the current print data and shift register B for the past print data. Since during this initial cycle all print data is "0", a first activation period of strobe signal ST2 is applied as output providing an activating current having a pulse width, $TW_0$, to thermal elements 50, via circuit selection groups 70, relative to any bit register in shift register A having a HIGH or "1" state. During this initial cycle, all shift register B outputs to gate circuit groups 70 were initially "0". Then, when ST1 becomes HIGH, and the print data from shift register A is applied to thermal elements 50 for a second activation period equal to pulse width $TW_1$. Thus, the total drive period for the thermal elements in each print cycle is divided into two possible activation periods, $TW_0$ and $TW_1$. A heating element, whose current print data and past print data both provide a value of "1", is activated for only the second activation period of $TW_1$. A heating element whose current print data is a value of "1" and whose past print data was a value of "0" is activated for both the second and first activation periods, $TW_1+TW_0$, wherein $TW_0$ represents the historical drive portion of the total activation time.

Thus, when ST1 signal is HIGH, only shift register A is in use. As a result, shift register B is not in use so that the changing of print data stored in its bit registers will have no effect on the current print data in shift register A. Therefore, when the ST1 signal changes to HIGH, which provides for an enabling state to output the current print data from shift register A, the next or new line of current drive data may be provided as input to shift register B via terminal 72. When the input of this data is completed at the second timing pulse, $t_2$, EN-A/B goes LOW, and gate circuits 16, 17 are operative to switch to shift register B for current print data while the employment of the previous current data in shift register A (now designated as the past print data) is compared with this new data to determine the activation time for the next line of current print data. As a result, thermal elements 50 may be optimally controlled based on the past print history from the previously stored current data present in the alternate shift register, which is currently not receiving the current print data. This same kind of activation control is applied in subsequent print cycles T2, T3, etc.

While past methods utilizing one or two latch circuits to store the current and past print data, a thermal head for a recording apparatus according to this invention employs shift register pairs with data switching circuits that alternately store the past and current print data thereby eliminating any requirement for latch circuits. Moreover, since in U.S. Pat. No. 4,364,063, the comparison of current print data with historical or past print data is done on a serial basis, significantly more time is require to accomplish the referencing as compared to the referencing circuitry of this invention.

This drive device is further configured such that data input is disabled when ST2 is inputted to AND circuits 35, 36 and historical drive control is performed by means of NAND circuit 13. To this end ST2 is applied to AND gates 35 and 36 via an inverter 37 thereby to prevent clock pulses from being applied to any of the shift registers.

The control sequence described above relative to the operation of the circuit of FIG. 1 is conventionally controlled by means of a processor. It is, therefore, possible to monitor the ST2 signal of second strobe input terminal 22, which is employed for setting the second activation period, by means of such a processor to prevent accidental replacement of drive data in one of the shift registers.

As shown in FIG. 1, drive control unit 60 of the print head control apparatus for a recording apparatus according to this invention comprises components that can be individually tailored according to the N bit size of the thermal head. The size of control unit 60 can be accordingly adjusted to the N bit size of the thermal head by eliminating the common circuit components, such as, the data input, strobe inputs, the other components, i.e., drive control unit 60 can be integrated on a single semiconductor chip. In addition, because these common components, i.e., data input/output timing control unit 40, are not part of the chip circuitry, the semiconductor chip, comprising drive control unit 60, can be mass produced at a cost reduction compared to the cost which would include data input/output timing control unit 40. More will be said about this later in connection with FIG. 6.

Also, as shown in FIG. 1, there are shift register data input terminals 61 and 63, shift register clock input terminals 62 and 64, and shift register data output terminals 71 and 72. It should be noted that, as the number of shift registers is increased laterally, i.e., in cascade, to form the shift register unit capable of accommodating an extended print line or lines for a larger thermal print head (i.e., according to the number of thermal elements 50 to be employed), the data output terminals 71, 72 are respectively connected to the input terminal 61, 63 of the next succeeding shift register. First and second current enabling terminals 66, 68 select whether the drive data input to the shift register, currently selected to store the current print data, is the proper output to thermal elements 50 and, accordingly, sets the activation period. Third and fourth enabling terminals 67, 69 select, based on the output of NAND circuit 13, provide a current pulse having a pulse width $TW_o$ as output, via gate circuits 14 and 15, to thermal elements 50. Thus, the determined activation period is provided via these gates where one shift register is selected as the store of current print data and the other shift register is selected as the store for past print data.

The foregoing disclosed embodiment of this invention, as well as other embodiments, hereafter described, may be employed with different types of print heads that print information utilizing thermal elements including, for example, thermal printers employing a thermal print head, thermal transfer printers, and bubble type, ink jet printers.

Figure 3:
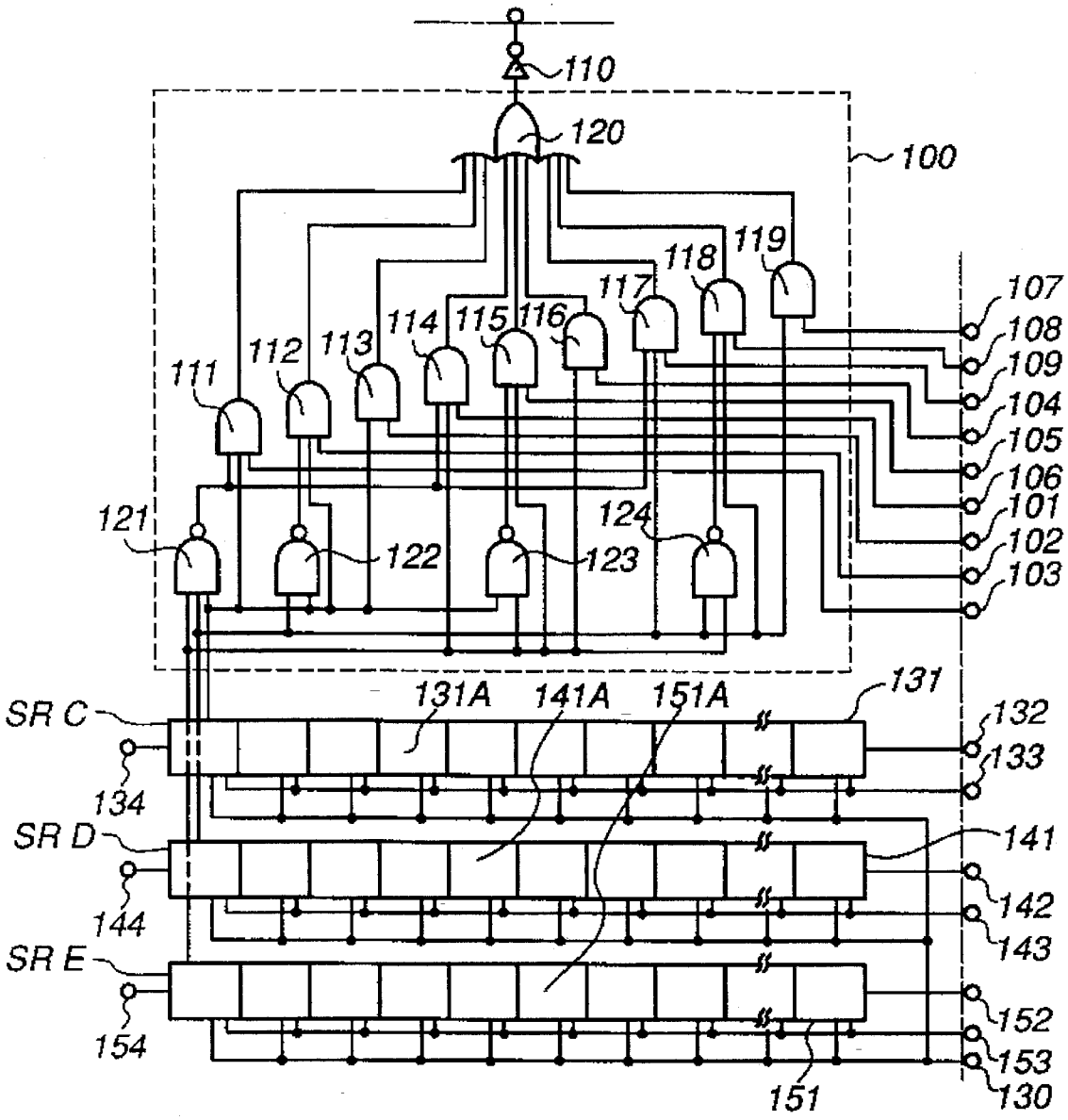
FIG. 3 is a circuit diagram of a second embodiment of an IC drive control section of a print head drive apparatus in accordance with this invention.

It should be noted that, in the embodiment of FIG. 1, the activation period is set by referencing the past print data relative to only the immediately preceding print cycle wherein this now past print data was the current print data. However, three shift registers can be sequentially employed to enable historical control comparison relative to past print data for the two preceding print cycles. As above, it is again sufficient to configure the three shift registers so that the shift register, to which the current print data is provided as input, are sequentially selected. In addition, there is generally a significant difference between the activation period relative to normal current print data and the activation period relative to historical comparison. Even in the case where there are many data bits in the print line, as with an extended line print head, there is sufficient time to input data to the second shift register during the time in which the drive data is provided as output from the first shift register. This time is during the activation period, $TW_1$, in the embodiment of FIG. 1. In this regard, reference is now made to FIG. 3 relative to another embodiment of this invention. The embodiment shown in FIG. 3 is suitable to driving the thermal head in a high speed thermal printer employing several shift registers for comparison of extended past data history. High speed thermal printers generally reference an extended drive data history as a means of improving print quality and extending print head life since the print head thermal elements are not continually heated to higher levels than necessary or desired. The shift registers 131, 141, 151 or SR C, SR D, and SR E, are of the same type as shift registers SR A and SR B of the first embodiment, previously described. Shift registers 131, 141, 151, respectively, have data input terminals 132, 142, 152, clock input terminals 133, 143, 153, and data output terminals 134, 144, 154. Reset terminal 130 is common to a three shift registers C, D, and E.

Gate circuit group 100 corresponds to an output for one out of a total of N thermal elements in the thermal print head. Therefore, N gate circuit groups 100 are provided for N thermal elements. The input of each gate circuit group 100 is connected to a respective $n^{th}$ single bit register 131A, 141A, 151A of respective shift registers C, D, and E. Each $n^{th}$ bit register of these three shift registers correspond to the same $n^{th}$ thermal element of the plurality of N thermal elements. Each gate circuit group 100 comprises NAND gate circuits 121–124, AND circuits 111–119 and OR circuit 120. NAND gate circuit 121 obtains the NAND result of the outputs of the $n^{th}$ bit registers 131A, 141A or 151A. NAND gate circuits 122, 123, 124 obtain the NAND result of any two $n^{th}$ bit registers of the $n^{th}$ bit registers 131A, 141A, 151A Input terminals 101–109 receive signals to control the timing and duration of drive pulses supplied as output to the thermal elements, which is either to provide the activation period directly to the thermal elements for the current print data or the result of a respective NAND gate output compared with the corresponding current print data output. Gate circuits 111–119 provide an output of the AND result of the respective signals at input terminals 101–109. Gate circuit 120 is connected to the outputs of AND gate circuits 111–119 and combines the AND inputs from these gate circuits 111–119 to provide the total activation period for driving correspondingly connected thermal elements by means of thermal element drivers 110.

If the number of individual single bit registers or stages in each of shift registers C, D, E is equal to N, then, there is a corresponding N number of gate circuit groups 100 and N head drivers 110 in the print head control apparatus, although only one each is shown in FIG. 3 for purposes of simplified explanation. Input terminals 101–109 providing the various pulse width inputs are connected in common to all of the N gate circuit groups 100.

Explanation is now made as to the operation of the head control apparatus according to FIG. 3. Immediately after the power is applied to the recording apparatus, shift registers C, D, E are cleared by means of the RESET signal via common reset terminal 130 during the recording apparatus initialization process. Assuming that the initial current print data is provided as input first to shift register C, then shift registers D and E are thereafter sequentially selected, via selection timing of CL1, CL2, CL3, for receiving current print data input. For example, at the next printing cycle after timing pulse $t_2$, the current data in shift register C is held and new print data is provided as input to shift register E. At the next timing cycle, $t_3$, the current data in shift registers C and E is held and new print data is provided as input to shift register D. As this cycling is repeated, the next new data will be written into shift register C, thereby erasing the previously stored print data. At this point, shift register D will hold the print data from the immediately previous print cycle and shift register E will hold the print data from two previous print cycles.

At the end of the print cycle after timing pulse $t_3$, storing the print data held from the previous two print cycles is compared with current print data via NAND circuit 121. If the past print data bits relative to a given trio of $n^{th}$ bit registers 131A, 141A, 151A of SR C, SR D, SR E are HIGH or "1", an activation state or period will not occur even if the corresponding terminal input 103 is set HIGH. On the other hand, if one of the print data bits of the two past print cycles is LOW or "0", current is supplied via AND gate circuit 111 for the pulse width, $TW_2$, provided via input terminal 103. Then, print data in shift register D, storing the print data held from the immediately preceding print cycle is then compared via NAND gate circuit 122. If the past print data from this preceding cycle was HIGH or "1", NAND gate circuit 122 will provide an output of "0". If the past print data from preceding print cycle was "0", NAND gate circuit 122 will provide an output of"1" and current is supplied for the pulse width, $TW_3$, from input terminal 102. Then, based on the input from input terminal 101, current is supplied according to the current print data stored in shift register C for the pulse width, $TW_4$.

As described in connection with the first embodiment, if activation of the thermal elements, based on the print history, is executed at the beginning of the activating timing, rewriting the past print data will then have no adverse affect on the activation of the current print cycle. As a result, the data stored to shift register E is rewritten with new print data for the next print cycle, the replaced print data having already been compared with more current print data during the two preceding print cycles.

An explanation of the print cycle control process can be described as follows. If at any given print cycle beginning at timing pulse, $t_n$, the current print data was provided as input to shift register C during the previous print cycle at timing pulse $t_{n-1}$, the control process at timing pulse, $t_n$, can be summarized as follows:

(a) Comparison of print data in SRs C, D, E;

(b) Control activation→compare current print data with past print data in shift register D;

(c) Comparison of current print data in SR C with SR D and SR E;

(d) Control activation;

(e) Rewrite data in SR E with new current drive data→output current print data from shift register C→end print cycle $t_n$→control activation→advance to next print cycle at timing pulse $t_{n-1}$ (f) Repeat the sequence set forth in (e) while cyclically substituting SR C, SR D and SR E relative to each other.

By sequentially switching through the shift registers synchronized to print cycles, historical control comparison of past print data from two preceding print cycles can be effectively accomplished to optimize uniform printing quality.

As mentioned in connection with the embodiment of FIG. 1, the circuitry of FIG. 3 can be integrated on a single semiconductor chip and can be applied to a print line-type thermal head by increasing the number of individual registers and gate circuit groups 100 according to the number of thermal elements desired for a single print line or lines.

Figure 4:
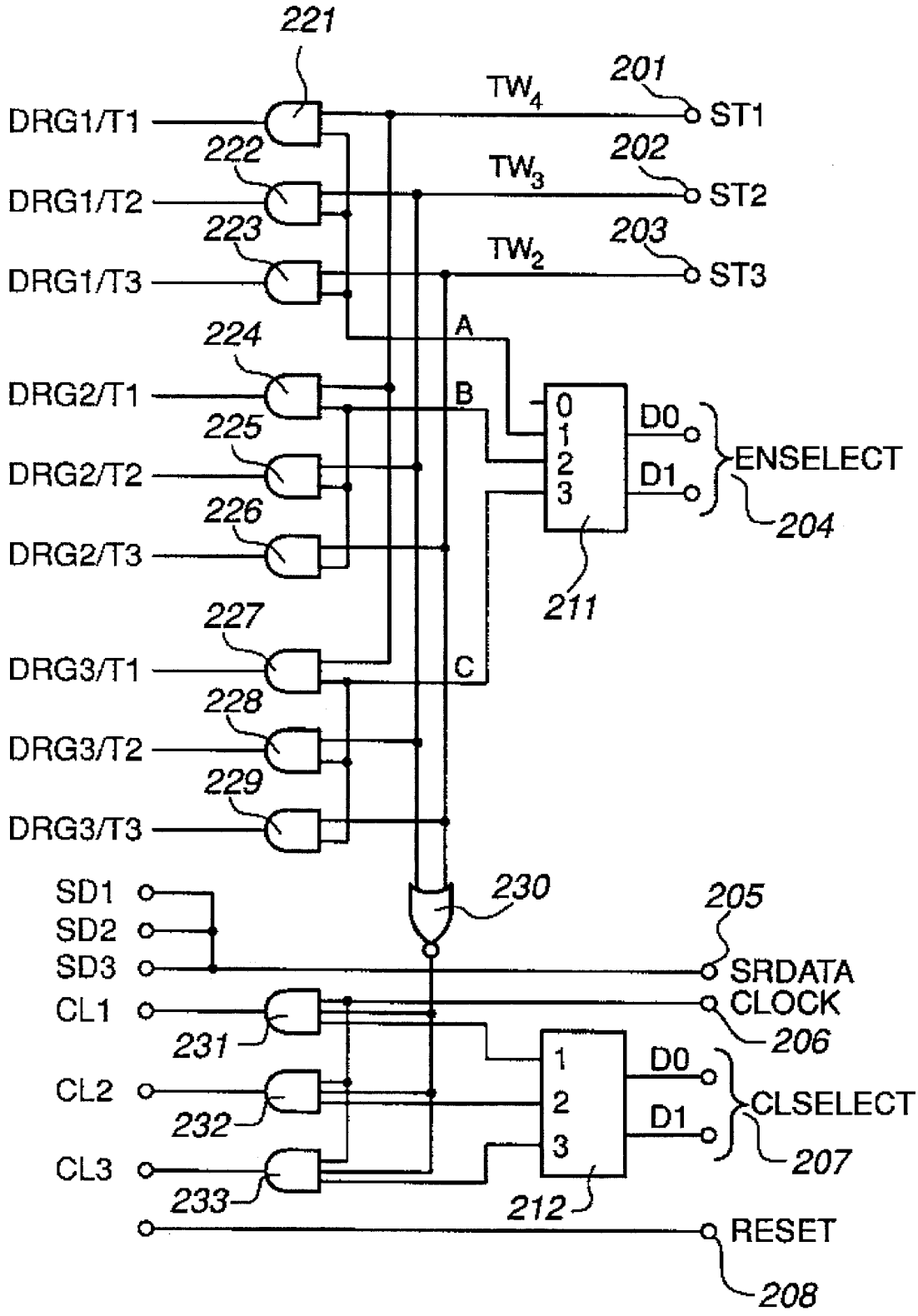
FIG. 4 is a circuit diagram of a data input/output timing control section of the print head control apparatus according to FIG. 3.

FIG. 4 is a circuit diagram of the peripheral drive circuit for gate circuit selection groups 100 shown in FIG. 3.

The connection relationship between the DRG outputs of FIG. 4 and the input terminals 101–109 of FIG. 3 are as follows:

| DRG Output | Terminal Input |
|---|---|
| DRG1/T1 | 101 |
| DRG2/T1 | 104 |
| DRG3/T1 | 107 |
| DRG1/T2 | 102 |
| DRG2/T2 | 105 |
| DRG3/T3 | 108 |
| DRG1/T3 | 103 |
| DRG2/T3 | 106 |
| DRG3/T3 | 109 |

With reference to FIG. 4, the activation period comprising combinations of the timing periods are specified by strobe signals ST1, ST2, ST3 applied to strobe input terminals 201, 202, 203. Decoder 211 provides a one-out-of-three bit output from the two bit input ENSELECT signal D0, D1 at enable select terminal 204 of decoder 211. Output signals DRG1/T1–T3; DRG2/T1–T3; and DRG3/T1–T3 are achieved by means of AND gate circuits 221–229 operating on the outputs received from decoder 211 and strobe signals ST1, ST2, ST3. Output DRG1/T1 is connected to terminal 101 in FIG. 3, output DRGlfr2 to terminal 102, and output DRG1/T3 to terminal 103. As an example, when shift registers B and D provide for comparison data based upon past print data history and shift register C is employed for current print data, input terminals 101, 102, and 103 are employed for activation signals with the total pulse length of activation dependent upon the past print data history. If output from decoder 211 is A=1, B=0, C=0 when the ENSELECT input signals to decoder 211 are D0=0 and D1=1, data input is enabled only to AND gates 221, 222, 223. DRG1/T1 is output for the strobe ST1 signal providing a pulse width, $TW_2$ (FIG. 5), and drive output is obtained according to the print data in shift register C. The activation period is similarly set for input terminals 102, 103 according to the respective pulse widths, $TW_3$ and $TW_4$, of strobe signals ST2 and ST3, via enabled AND gates 222, 223, and the output, based on the past print data, as previously explained, is applied to the thermal elements.

The input of serial data, i.e., the SRDATA signal, is applied to input terminal 205 and distributed as signals SD1, SD2, and SD3 to data input terminals 132, 142, 152 of SRs C, D, E in FIG. 3. The clock signal (CLOCK) is applied to clock input terminal 206, and the clock select or enable signals (CSELECT) are applied from clock selection terminals 207. The two bit input D0, D1 from clock selection terminals 207 is converted to a one-out-of-three bit output by decoder 212. The single bit output of decoder 212 as well as the CLOCK signals are two of the three inputs to AND gate circuits 231, 232, 233. Gate circuits 231, 232, 233 provide output clock signals CL1, CL2, CL3, which provide for selected input to the respective SRs C, D, E. NOR gate 230 functions in a manner similar to inverter 37 in FIG. 1, in that, it inhibits the clock inputs, CL1, CL2, CL3 when strobe inputs ST2, ST3 are in their enabled or ON state since the historical results are being obtained employing the output of past print data as input to gate circuit groups 100. As a result, only when current print data is being provided as an output, then new print data is enabled as input to the appropriate shift register via enabled output clock signals CL1, CL2, CL3. Reset terminal 208 provides for concurrent reset of shift registers C, D, E via input terminal 130.

Figure 5:
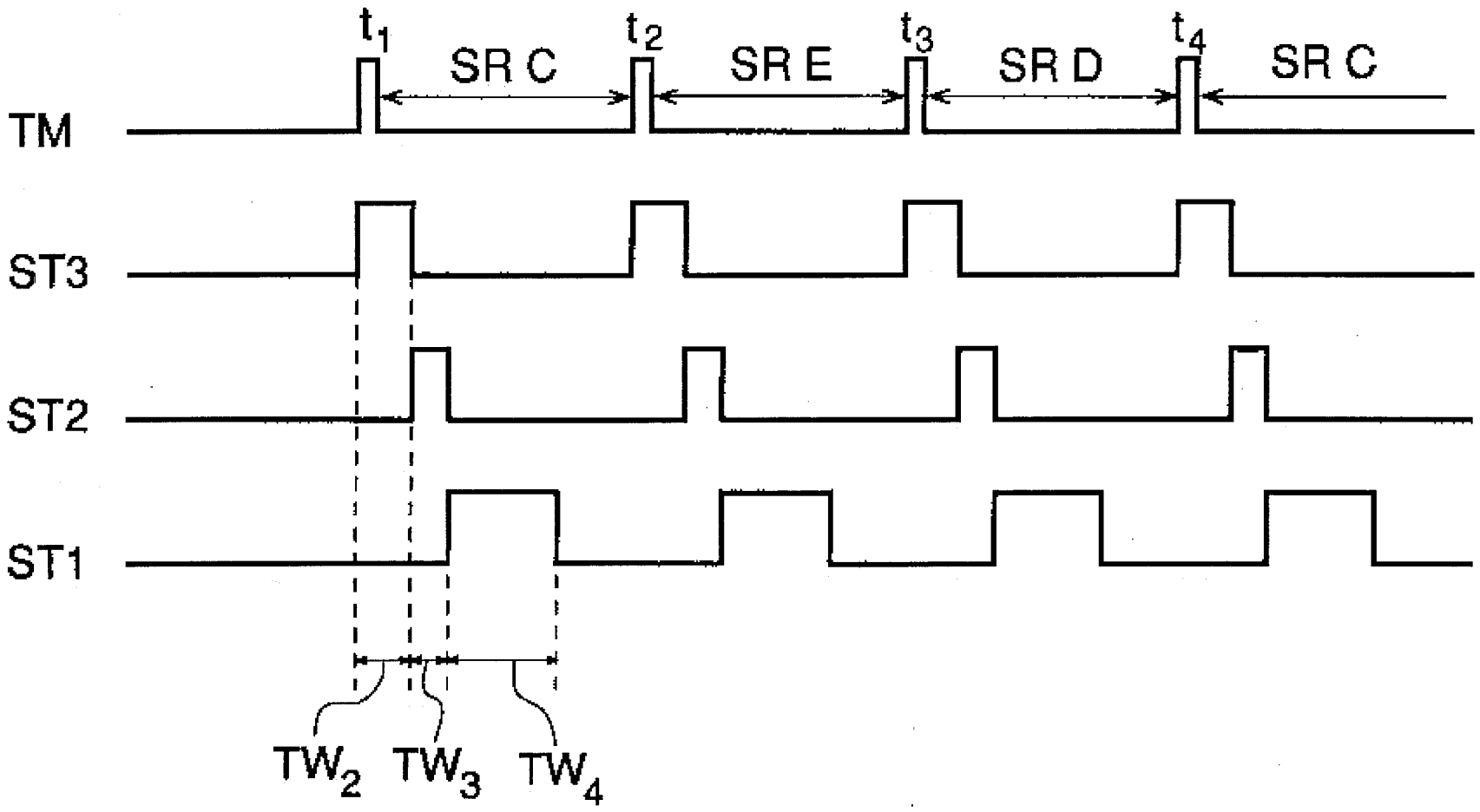
FIG. 5 is a timing diagram for explaining the drive method of the invention for the circuits as shown in FIGS. 3 and 4.

FIG. 5 is a timing diagram to show the relationship of the strobe ST1, ST2, ST3 for the embodiment of FIG. 3. In addition to the basic timing signal TM for consecutive print cycles between timing pulse $t_n$, the strobe signals ST1, ST2, ST3 are shown.

As shown in FIG. 5, the shift register holding the print data for the current print cycle is cyclically changed in a sequence via shift registers C, E, D, C, etc. every print cycle as printing advances through print cycles between timing pulses $t_1$, $t_2$, $t_3$, $t_4$, etc. During each print cycle, the strobe signals ST3, ST2, ST1 are provided as output to groups 100 in sequence for the corresponding pulse widths $TW_2$, $TW_3$, $TW_4$. The pulse widths $TW_2$, $TW_3$, $TW_4$ can be chosen singularly or in combination to provide for a total activation period dependent upon print data history of the two preceding print cycles. If, in a given print cycle, the print data in both preceding print cycles were "0" for a given trio of $n^{th}$ bit registers 131A, 141A, 151A while that for the current print cycle is "1", the activation period for the print data is provided with a current pulse width output equal to the pulse width of $TW_2+TW_3+TW_4$. However, if only one of the preceding print cycles was "1", the activation period for the print data is provided with a current pulse output equal to the pulse width of $TW_2+TW_4$. Moreover, if the print data in both preceding print cycles were "1", while that for the current print cycle is "1", the activation period for the print data is provided with a current pulse output equal to only the pulse width, $TW_4$. Thus, by means of this embodiment, an applied pulse width is adjusted according to the past print data of two previous print cycles by sequentially selecting the shift register to which current print data is to be provided as input and adjust current pulse output for the current print data to the thermal elements according to past print data history.

The embodiment of FIGS. 3–5 is not be limited to historical drive data from just two previous print cycles, as it will be obvious to those skilled in the art that historical data can be referenced further back to three, four, or more past data cycles by corresponding increase in the number of shift registers employed. As a result, a print head control apparatus of this type for controlling thermal elements can offer high print uniformity and quality through a comparatively simple IC circuit design.

Figure 6:
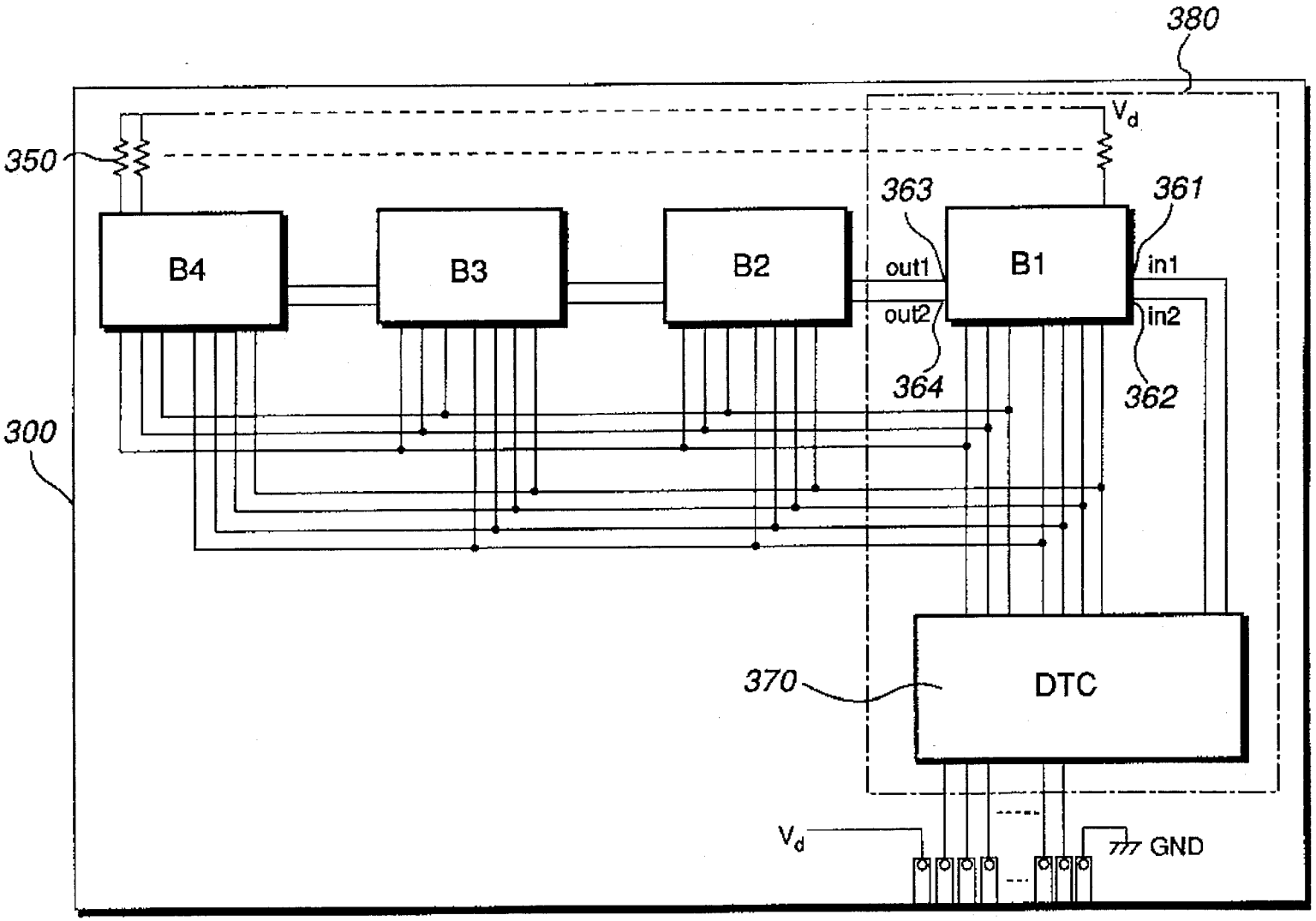
FIG. 6 is a layout diagram of the IC chips comprising the drive control sections of either FIG. 1 or FIG. 3 as applied to a thermal print head control apparatus for a recording apparatus comprising this invention.

By integrating the control circuit, shown in either FIG. 1 or 3, onto a single semiconductor chip as a fully integrated circuit and mounting a plurality of such IC chips on a thermal print head, simplified conductive lead line patterns on the circuit board on which the IC chips are mounted is easily achieved, permitting an increase in the number and density of total thermal elements per a given length. FIG. 6 is a layout diagram showing the location of the IC chips on a thermal head 300 having thermal elements 350. For example, each individual IC chip B1, B2, B3 and B4 comprises a drive control unit 60 including shift registers A and B. For example, the IC chip B4 has a 64 bit drive output terminals so that the four IC chips B1–B4 provide for a total of 256 thermal elements 350 on thermal head 300. IC chips B1–B4 are connected in a cascade by means of serial data input terminals 361, 362 and data output terminals 363, 364 and together form a shift register unit comprising the shift registers in IC chips B1–B4. Data input/output timing control (DTC) chip 370 provides for control of the input of serial data, driving time and the activation period, as in the case of peripheral timing control unit 40 of FIG. 1 of the circuit of FIG. 4. In the case where IC chips B1–B4 are of the architecture of FIG. 1, it is necessary to provide for 9 connection lines for each IC chip. However, with the connection configuration shown in FIG. 6, it is only necessary for 7 lines to be established between the DTC and all of the chips B1–B4, even though 4 IC chips are employed. The effect of reducing the number of lines is even greater in the case of the ICs having an the architecture of FIG. 3 wherein the number of employed shift registers is increased.

When DTC 370 is integrated as a drive control unit on a single semiconductor integrated circuit chip to form IC chip 380 wherein lines between the DTC and drive control unit in chip B1 are electrically connected or disconnected by means of gate circuits or the like, it is possible to employ the DTC function of IC chips 380 among several of the IC chips, such as, B2–B4. This eliminates the need of additional DTC's on the same thermal head and reduces the number of circuit patterns required on the thermal head so that the reliability of the thermal head is increased.

Moreover, when a line-type thermal head for which the number of thermal elements cover the line width of A4 paper is employed in a recording apparatus, it is uncommon to provide for activation of all thermal element simultaneously due to the limitations of the recording apparatus power supply. In this situation, the thermal elements of the thermal head are generally controlled by being divided into several subsections along the print line direction with DTC's located per subsection to control a respective drive control section of one of the IC chips B1–B4 so that the control for each subsection is carried out via the connected series of cascaded IC chips B1, B2, B3, B4, etc. Also, an additional advantage is achieved by integrating the DTC with only one timing control unit 40 forming a single IC chip 380.

In summary, data storage circuits can be efficiently employed through the provision of a plurality of shift registers and switching between or among these cascaded units relative to the current print data and the past print data thereby reducing the cost and circuit complexity of thermal head control circuit while enabling historical control comparison with past print data without sacrificing print quality and uniformity. Also, it is possible to achieve a control method compatible with high speed system operation and providing sufficient time for data transfer without the requirement of or need for latch circuit operation as is required in conventional thermal recording apparatus.

Moreover, with the utilization of the basic concept of this invention, it is possible to easily reference three, four, or more generations of past print data with the printing of current print data without increasing the complexity of the data drive and control circuits.

A print head drive control apparatus according to this invention can also be flexibly adapted to line thermal print heads or thermal print heads having a large number of thermal elements with simplified circuitry for historical control of the applied current pulse timing to the thermal head heating elements. As a result, the cost benefits become greater with the increase of thermal elements employed on the print heads. Moreover, this invention can be applied, not only to a thermal print head, but also to a bubble jet type of ink jet head whereby the heat accumulation in the high speed printing is suppressed resulting in stabilized ink ejection over a wide range of operating conditions.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. A recording apparatus having a print head drive apparatus for printing by driving a plurality of N thermal elements, and comprising:

at least two shift registers having N single bit resisters corresponding to N thermal elements for serially receiving drive data as input and for transferring said data in parallel as output, said single bit registers of said shift registers connected to drive a corresponding thermal element of said plurality of N thermal elements, means to input serial drive data selectively to either of said shift registers, first gate means for selectively providing the output of drive data from either of said shift registers to said thermal elements, first activating timing means for setting the duration of time of the output of said first gate means, second gate means for comparing N-bit data of respective 1-N single bit registers of said at least the two shift registers corresponding to the same 1-N thermal elements, third gate means for deciding whether to output the result of said second gate means to said thermal elements according to the each bit of the drive data, second activating timing means for setting the duration of time of the output of said third gate means, and output selection means for selecting which output of said at least two shift registers should be provided to drive said thermal elements of drive data, the improvement comprising:

said input means to one of said at least two shift registers to store current print data for a next print cycle and said input means to the other of said at least two shift registers to store past print data from an immediately previous print cycle, said second gate means comparing the current print data to the past print data for respective of said 1-N single bit registers of said at least the two shift registers, said input means to the other of said at least two shift registers having stored past print data, provided to receive new drive data and redesignated as the store for current print data, said one of said at least two shift registers thereafter redesignated as the store of past print data, said second gate means comparing the new drive data to the past print data for respective of said 1-N single bit registers of said at least the two shift registers, the selection of the time output of said first and third gate means based upon said gate comparison of current print data with past print data through sequential shifting of said at least two shift registers for setting the activation time of the thermal elements.

2. The recording apparatus according to claim 1 further comprising fourth gate means for disabling shift register print data input when the second activation time setting means is in an ON state.

3. The recording apparatus according to claim 1 further comprising input selector means for selecting which of said at least two shift registers should be enabled to receive current print data.

4. The recording apparatus of claim 1 wherein said print head drive apparatus is an integrated circuit mounted on a print head for said recording apparatus.

5. The recording apparatus of claim 4 wherein said print head comprises N thermal elements mounted on a substrate, a plurality of integrated circuits mounted on said substrate wherein said circuits comprise shift register units serially connected in cascade according to N number of thermal elements on said print head, each of said integrated circuits having at least two shift registers for connection to a portion of said print head thermal elements.

6. The recording apparatus of claim 4 wherein said print head is a thermal print head.

7. The recording apparatus of claim 4 wherein said print head is an ink jet print head or bubble jet type print head.

8. A recording apparatus comprising a print head drive apparatus for selectively driving, through a plurality of print cycles, a plurality of N thermal elements (50; 350) in a print head of said recording apparatus, wherein the activation period for each thermal element in each print cycle is divided into M successive time intervals ($TW_0$, $TW_1$; $TW_2$, $TW_3$, $TW_4$), said apparatus comprising:

M storage means (11, 12; 131, 141, 151) for storing M sets of print data, each set including data for application to said thermal elements, said M sets of print data corresponding to a current print cycle and to M−1 preceding print cycles, timing means (21–25, 31–34) for defining said M time intervals, first means (13–15; 111, 114, 117, 121) for generating a first signal for activating respective of said thermal elements during said first time interval depending on the respective print data in each of the sets of print data corresponding to the current print cycle and the M−1 preceding print cycles, second means (17, 16; 113, 116, 119) for generating a second signal for activating respective of said thermal elements during the $M^{th}$ time interval depending on the respective print data in the set of print data corresponding to the current print cycle, and input means (26, 35, 36; 205, 212, 231–233) for selectively inputting a new set of print data for the next print cycle into the storage means previously holding the set of print data corresponding to M−1 preceding print cycle, said input means responsive to said timing means for performing the new print data input between the end of said first time interval and the end of the current print cycle.

9. The recording apparatus of claim 8 wherein if M>2, third means (122, 123, 124, 112, 115, 118) for generating respective signals for activating respective of said thermal elements during each of the second to M−1 time intervals depending on the respective print data in predetermined combinations of said sets of print data excluding the set corresponding to the M−1 preceding print cycle.

10. The recording apparatus of claim 8 wherein each of said storage means (11, 12; 131, 141, 151) is a shift register having a plurality of stages corresponding to the number of heating elements (50; 350), a serial input terminal (61, 63; 132, 142, 152), parallel output terminals and a clock input terminal (62, 64; 133, 143, 153), and said input means (26, 35, 36; 205, 212, 231–233) including means for applying a serial data stream comprising said new set of print data to a selected shift register.

11. The recording apparatus of claim 10 wherein said serial data stream is applied in parallel to all shift registers (11, 12; 131, 141, 151), and clock input means (35, 36; 212, 231–233) is provided for selectively applying a clock signal to the clock input terminal of the selected shift register.

12. The recording apparatus of claim 11 further comprising means (37; 230) for disabling said dock input means (35, 36; 212, 231–233) during said first time interval ($TW_0$; $TW_2$).

13. The recording apparatus of any one of claims 10 to 12 wherein M equals 2, said timing means comprises means (21, 22) for receiving first and second strobe signals (ST2, ST1), defining first and second time intervals ($TW_0$, $TW_1$), respectively, and timing gate means (31–34) for outputting said strobe signals to either a first group of first and second terminals (67, 66) or a second group of third and fourth terminals (69, 68), said groups of terminals being alternately used every print cycle in response to a selection signal (EN-A/B) applied to said timing gate means, said second means comprises for each thermal element (50) first and second gate means (17, 16) having first inputs respectively connected to corresponding bit stages (11A, 12A) of the first and second shift registers (11, 12), and second inputs respectively connected to said second and fourth terminals (66, 68), said first means comprises for each thermal element (50) third gate means (13) for comparing print data in corresponding stages (11A, 12A) the first and second shift registers (11, 12), fourth and fifth gate means (15, 14) having first inputs commonly connected to the output of said third gate means, second inputs respectively connected to corresponding bit stages of the first and second shift registers, and third inputs respectively connected to said first and third terminals (67, 69), and sixth gate means (18) for each thermal element (50) for combining the outputs of said first, second, fourth and fifth gate means.

14. The recording apparatus of any one of claims 10 to 12 wherein M equals 3, said timing means comprises means (201, 202, 203) for receiving first, second and third strobe signals (ST3, ST2, ST1), defining first, second and third time intervals ($TW_2$, $TW_3$, $TW_4$), respectively, timing gate means (221–229) and gate selection means (211) responsive to a selection signal (EN-C/D/E) for outputting said strobe signals to either a first group of first, second and third terminals (103, 102, 101), a second group of fourth, fifth and sixth terminals (106, 105, 104) or a third group of seventh, eighth and ninth terminals (109, 108, 107), said groups of terminals being alternately used every print cycle in a cyclic order under control of said gate selection means, said second means comprises for each thermal element first, second and third gate means (113, 116, 119) having first inputs respectively connected to corresponding bit stages (131A, 141A, 151A) of the first, second and third shift registers (131, 141, 151), and second inputs respectively connected to said third, sixth and ninth terminals (101, 104, 107), said first means comprises for each thermal element fourth gate means (121) for comparing print data in three corresponding bit stages (131A, 141A, 151A) of the three shift registers (131, 141, 151), and fifth, sixth and seventh gate means (111, 114, 117) having first inputs commonly connected to the output of said fourth gate means (121), second inputs respectively connected to corresponding bit stages of the first through third shift registers, and third inputs respectively connected to said first, fourth and seventh terminals (103, 106, 109), said third means comprises for each heating element eighth to tenth gate means (122, 123, 124) for comparing print data in the two corresponding stages (131A, 141A, 151A) of each pair of the three shift registers (131, 141, 151) and eleventh to thirteenth gate means (112, 115, 118) having first inputs respectively connected to the outputs of said eighth to tenth gate means (122, 123, 124), second inputs respectively connected to the corresponding stages of the first through third shift registers, and third inputs respectively connected to said second, fifth and eighth terminals (102, 105, 108), and fourteenth gate means (120) for each thermal element for combining the outputs of said first to third, fifth to seventh and eleventh to thirteenth gate means.

15. A method for controlling the operation of a print head in a recording apparatus based on past print data history, the print head having a plurality of thermal elements, comprising the steps of:

(a) providing at least two shift register each having a plurality of individual bit registers corresponding in number to the thermal elements, (b) sequentially inputting print data to the shift registers during consecutive enablement periods so that at one shift register alternately stores current print data and at least one other shift register alternate stores past print data for every print cycle, (c) referencing the stored past print data with the stored data, (d) outputting the referenced print data to the thermal elements during a first actuation time interval, (e) outputting current print data stored in one of the shift registers to the thermal elements during a second actuation time interval, (f) inputting the next new print data to the shift register employed as reference for the past print data after commencing the outputting of data current print data in step (e), (g) designating the shift register used for outputting the current print data in step (e) as the store of past print data, and (h) repeating the process of steps (c) (g).

16. The method according to claim 15 further comprising the steps of:

(i) referencing the past print data during the first activation time interval, (j) outputting the current print data to the thermal elements after outputting the referenced results of step i, and (k) transferring the next print data to the shift register previously storing the past print data during the output of current print data to the thermal elements.

17. A print head control apparatus coupled to a print head having a plurality of N thermal elements for print head control based on referencing past print data to dynamically control the print energy supplied to said thermal elements according to their past print data historical experience, comprising:

drive elements controlling the on/off state of N thermal elements, at least two shift registers having N bit registers corresponding to N thermal elements, in a current print cycle, one of said shift registers storing current print data and the other said shift registers storing past print data, serial input terminals for said shift registers for sequentially inputting current print data to be printed by the thermal elements, first gate means corresponding to the number of N bit registers for comparing current print data in one of said shift registers with past print data in others of said shift registers relative to each corresponding thermal elements, second and third gate means for determining an output for the current print data in one of the shift registers to said thermal elements and providing a driving signal to said thermal elements only for a first activation time interval, fourth and fifth gate means for determining, according to comparison provided from said first gate means, whether to output results of said first gate means to said thermal elements and providing a drive signal to said thermal elements for a second activation time interval, activation time input means for said second through fifth gate means for setting the first and second activation time intervals, enable means to input new print data, in a current print cycle, to the other said shift registers storing said past print data during the first action time interval, in the next succeeding print cycle, said other shift register redesignated as the shift register for storing current print data and said one shift register redesignated as the shift register for storing past print data.

18. A method of selectively driving a plurality of thermal elements in a print head of a recording apparatus having first to M storage means for storing M sets of print data with each set including print data for said thermal elements, wherein said thermal elements are driven through a plurality of print cycles and said first to M storage means employed to store first to M sets of print data corresponding to a current print cycle and the M−1 preceding print cycles, respectively, and each print cycle includes the steps of:

(a) during a first activation time interval driving each thermal element in accordance with the respective print data in each of the sets of print data corresponding to the current print cycle and the first to M−1 preceding print cycles, (b) during a last occurring activation time interval driving each thermal element in accordance with the respective print data in only the set of print data corresponding to the current print cycle, and (c) inputting after step (a) and before the end of step (b) a new set of print data for the next print cycle into the storage means previously holding the set of print data corresponding to the M−1 preceding print cycle.

19. The method of claim 18 further comprising the steps of:

(d) providing M>2 storage means, and (e) during each of following M−2 activation time intervals driving each heating element in accordance with the respective print data of predetermined combinations of said sets of print data excluding the set of print data corresponding to the M−1 preceding print cycle.

* * * * *